US009057570B1

(12) United States Patent
Tal et al.

(10) Patent No.: US 9,057,570 B1
(45) Date of Patent: Jun. 16, 2015

(54) LOADER FOR MAGAZINES WITH PROJECTING SIDE BUTTON

(71) Applicants: Guy Tal, Rosh H'ayin, IL (US); Ran Tal, Tel Aviv (IL)

(72) Inventors: Guy Tal, Rosh H'ayin, IL (US); Ran Tal, Tel Aviv (IL)

( * ) Notice: Subject to any disclaimer, the term of this patent is extended or adjusted under 35 U.S.C. 154(b) by 49 days.

(21) Appl. No.: 14/073,244

(22) Filed: Nov. 6, 2013

Related U.S. Application Data

(60) Provisional application No. 61/724,777, filed on Nov. 9, 2012.

(51) Int. Cl.
*F41A 9/61* (2006.01)
*F41A 9/83* (2006.01)

(52) U.S. Cl.
CPC ..... *F41A 9/83* (2013.01)

(58) Field of Classification Search
USPC ..... 42/87, 50, 90, 49.01
See application file for complete search history.

(56) References Cited

U.S. PATENT DOCUMENTS

| | | | | | |
|---|---|---|---|---|---|
| 1,245,499 | A | * | 11/1917 | Orme | 42/7 |
| 2,137,491 | A | | 11/1938 | Huff | |
| 2,514,277 | A | * | 7/1950 | Donnallan | 42/106 |
| 2,862,324 | A | * | 12/1958 | Ball | 42/50 |
| 2,864,193 | A | * | 12/1958 | Drew | 42/106 |
| 2,885,811 | A | | 5/1959 | Womble | |
| 3,509,655 | A | * | 5/1970 | Wilhelm | 42/50 |
| 4,488,371 | A | * | 12/1984 | Boyles | 42/90 |
| 4,827,651 | A | * | 5/1989 | Conkey | 42/87 |
| 4,829,693 | A | * | 5/1989 | Holmes | 42/87 |
| 4,872,279 | A | * | 10/1989 | Boat | 42/90 |
| 4,993,180 | A | * | 2/1991 | Upchurch | 42/87 |
| 5,074,070 | A | | 12/1991 | Kuykendall | |
| 5,129,173 | A | * | 7/1992 | Kuykendall | 42/90 |
| 5,355,606 | A | * | 10/1994 | Origoni | 42/87 |
| 5,377,436 | A | * | 1/1995 | Switzer | 42/87 |
| 5,402,594 | A | * | 4/1995 | Switzer | 42/90 |
| 5,417,003 | A | | 5/1995 | Claveau | |
| 6,178,683 | B1 | * | 1/2001 | Williams | 42/90 |
| 6,807,764 | B1 | * | 10/2004 | Phillips | 42/87 |
| 6,817,134 | B2 | * | 11/2004 | Newman | 42/87 |
| 2003/0046854 | A1 | * | 3/2003 | Urchek | 42/87 |
| 2004/0159035 | A1 | * | 8/2004 | Newman | 42/87 |
| 2004/0159036 | A1 | * | 8/2004 | Newman | 42/87 |
| 2013/0232843 | A1 | * | 9/2013 | Bajuelo | 42/87 |

* cited by examiner

*Primary Examiner* — Michelle R Clement
(74) *Attorney, Agent, or Firm* — David Pressman

(57) ABSTRACT

A magazine loader (10) for firearm magazines (40) has a projecting side button (50) coupled to a follower (52). Two similar and substantially flat flaps (12, 14) are hinged by a pin (18) along their longer side. A torsion spring (16) encompasses the pin and is positioned between the flaps, forcing them apart. Each flap has a substantially rectangular opening (20A, 20B) sized and positioned to fit over a magazine. The flaps can angle between an open position and a closed (parallel and touching) position. To load the magazine, a user squeezes and holds the flaps ends closed to align the openings so that the openings can be slid over the magazine to push the button down. Upon releasing the flaps they open, locking the openings on the magazine. Rounds (60) then can easily be loaded into the magazine. The loader may use a grasping member in lieu of flaps.

21 Claims, 4 Drawing Sheets

LOADER FOR MAGAZINES WITH PROJECTING SIDE BUTTON

CROSS REFERENCE TO RELATED APPLICATION

This patent issued from an application that claims priority of Provisional Patent Application Ser. No. 61/724,777, Filed Nov. 9, 2012.

BACKGROUND

Prior Art

Small firearms, including pistols, assault rifles, and submachine guns, utilize and fire rounds (also known as cartridges and ammunition). Each round is substantially elongated and comprises a deep cuplike case (also known as a shell casing and sometimes also a cartridge), usually of brass, which is filled with an explosive propellant. At its rear or closed end, the case has a rim or flange containing a primer; the front and opposite end of the case is open. A bullet, slug, or head, usually of lead (optionally jacketed) is partially inserted into the open or front end of the case and is retained there by crimping the case onto the bullet.

The rounds are usually held within and fed into the firearm from a magazine or clip. A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which is removably attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular end and includes two round-retaining members, known as feed lips. Magazines have an internal spring which urges a follower or pusher (blank shaped piece of plastic or metal) toward the open side. The follower in turn urges the rounds as a group up against the lips. The lips act as a stop for the rounds so that they are not expelled from the magazine.

Rounds are stacked or oriented in the magazine such that the longitudinal axes of the rounds are substantially parallel and perpendicular to the direction of travel of the spring and follower. Adjoining rounds are oriented side-by-side, i.e., the bullets of adjacent rounds are next to each other, as are the cases.

The rounds are usually stacked in the magazine, either in a single straight column (also called single-stacked) or in a staggered, zigzag, column fashion (also called double-stacked or high-capacity mags). The latter magazines, being wider, achieve higher round capacity compared to single-column magazines of the same overall length.

Commonly, in pistol magazines and in some submachine gun magazines, whether staggered or not, the space between the retaining lips is smaller than the case diameter of the rounds so that the two lips of the magazine hold the topmost round. Magazines of most assault rifles and submachine guns contain staggered rounds, and in contrast to the above pistol magazines, the topmost round is held in place by only a single lip; such magazines are not relevant here.

Prior to use, a firearm magazine must be loaded (charged or filled). When a magazine is being loaded, it is necessary to depress all previously loaded rounds to provide space below the lips so an additional round can be inserted. Each time another round is loaded the spring is further compressed, requiring more insertion force. When a magazine is fully loaded, the spring is fully compressed and exerts maximum upward force against the follower and rounds towards the lips.

Loading magazines is relatively time-consuming, tedious, and painful if done with bare fingers. Pain accumulates and intensifies as more rounds are loaded against the increasing spring pressure, thereby slowing the loading process. When a plurality of magazines are to be loaded, much time is required, shortening reposing, training, or combat time. In combat circumstances, slow reloading can be life-threatening.

Straightforward bare finger loading of magazines of the type where the topmost round is held by two lips begins with the user placing a new round in front of the lips on an existing round or follower. Then the user uses a thumb to force down the new round, any and all rounds below it, and hence the follower, down sufficiently to create enough space below the lips to slide the new round backward below the lips. The new round is then held between the lips above and the follower or second round below. The use repeats this procedure until the magazine is full.

To increase loading speed and decrease finger pain, several magazine manufacturers have developed magazines which have a slit opening along a portion of at least one side of the magazine where a button, pin, knob, or bulge connected to the magazine's follower protrudes or projects. Such magazines are commonly single-stacked and made, for example, for .22LR (long rifle) caliber rounds by Ruger for their Mark I, II, and III pistols, by Walther for their P22 pistol, by Beretta for their NEOS pistol, and by Smith and Wesson for their Model 41 pistol. The slit does not extend the full length or height of the magazine so the follower and its connected side button are limited in travel along the magazine. Hereafter the term 'magazine' will mean magazines which have (a) at least one opening side slit and a slidable side button connected to the follower and protruding from the slit for forcing down the follower, and (b) two lips holding the topmost round.

To load such a magazine, the user usually forces the side button down with the thumb to lower the follower, thus creating a vacant space below the magazine's lips so a new round can be slid easily inside the vacant space with the other hand. While such magazines may seemingly be less painful to load because the addition of the side button, most users still complain about thumb pain associated with repeated forcing and holding down the button while loading rounds. In most cases the button is small and/or has sharp edges, which makes pushing it down painful.

The prior art shows numerous attempts to provide loaders for such button magazines that increase loading speed and decrease finger pain associated with forcing down the button. All such loaders are simple and low cost, and usually comprise a single part made by plastic injection molding process. These are designed to interface the slider button of the magazine with a finger-rest large enough to comfortably push down the button, thereby avoiding the pain associated with pushing the button directly. Some prior-art loaders are shown in the following patents:

| U.S. Utility Patents | | | |
|---|---|---|---|
| Pat. or Pub. No. | Kind Code | Issue or Pub. Date | Patentee or Applicant |
| 2,137,491 | B1 | Nov. 22, 1938 | Huff |
| 2,514,277 | B1 | Jul. 4, 1950 | Donallan |
| 2,862,324 | B1 | Dec. 2, 1958 | Ball |
| 2,864,193 | B1 | Dec. 16, 1958 | Drew |
| 2,885,811 | B1 | May 12, 1959 | Womble |
| 3,509,655 | B1 | May 5, 1970 | Wilhelm |
| 4,488,371 | B1 | Dec. 18, 1984 | Boyles |
| 4,827,651 | B1 | May 9, 1989 | Conkey |
| 4,829,693 | B1 | May 16, 1989 | Holmes |
| 4,872,279 | B1 | Oct. 10, 1989 | Boat |
| 5,074,070 | B1 | Dec. 24, 1991 | Kuykendall |
| 5,402,594 | B1 | Apr. 1 4, 1995 | Switzer |
| 5,417,003 | B1 | May 23, 1995 | Claveau |
| 6,807,764 | B1 | 2004 Oct. 26 | Phillips |

Some prior-art loaders for magazines have a side slit with a button projecting from the slit. The top-most round is held by both lips. These loaders have a simple and similar design which includes an expanded finger-rest area adjacent the side button for making it less painful to push the button down. One problem with using these simple loaders is that the user has to constantly force the loader down with one hand while loading rounds with the other hand; otherwise the slider button may slide up. Other loaders have included a magazine base catch to hold the side button down. However these are not useful with most magazines as they are either magazine-specific or limited to a range of particular magazines because magazine bases vary in geometry, size, and shape.

Advantages

Accordingly, several advantages of one or more aspects of our loader design are as follows:

(a) a single loader is provided that can load a wide range of magazines, (b) the loader can lock and hold a side sliding button and follower in position anywhere along the magazine for allowing painless, comfortable, and non-continuous loading, (c) the loader that can be used more efficiently and comfortably than other loaders, (d) the loader is workable at relatively high speed with minimal fatigue to a user's fingers, with no force exerted on a single finger, (e) the loader is durable and is simple to operate in tough, varying conditions, and (f) the loader is low-cost, pocket-size, lightweight and has few parts.

Further advantages of one or more aspects of our loader will become apparent from a consideration of the drawings and ensuing description.

SUMMARY

A tool and method for facilitating loading loose rounds, usually .22LR caliber, into a firearm magazine basically comprises, in one aspect, four parts: two substantially similar flaps, wings, or plates, a hinge pin, and a torsion spring. The flaps are hinged together at one longitudinal edge by the pin. The torsion spring is positioned between the flaps and encircles the hinge pin with its windings while its legs force the flaps apart from their underside, thus forming a spring-loaded V-shaped loader. The flaps include a mechanism for limiting the open V angle between them. The loader flaps are movable between an open V-position to a closed parallel position. Each flap has a similar rectangular opening sized to accept a magazine inside where the two openings are positioned equally relative and parallel with the hinge. The dimensions of the openings are slightly larger than the cross-sectional dimensions of the magazine group for which the loader is made. When the flaps are forced closed, i.e., parallel, the magazine can be inserted in both openings and move freely inside. When the flaps are released, thus creating an angle between them, the magazine is forcefully locked by the outward torque of the flaps. To initiate loading, the user squeeze-closes the two flaps and inserts the loader onto the magazine and comfortably forces the projecting slider button all the way down along the magazine with the loader. The user then releases the flaps causing them to forcefully angle apart, thus locking the loader on the magazine at its current position. While the follower is locked down by the loader, the user can easily insert one to all rounds into the magazine. Once the magazine is full of rounds, the two flaps are squeezed close and the loader can be slid up off the magazine.

DRAWINGS

Figure 1A:
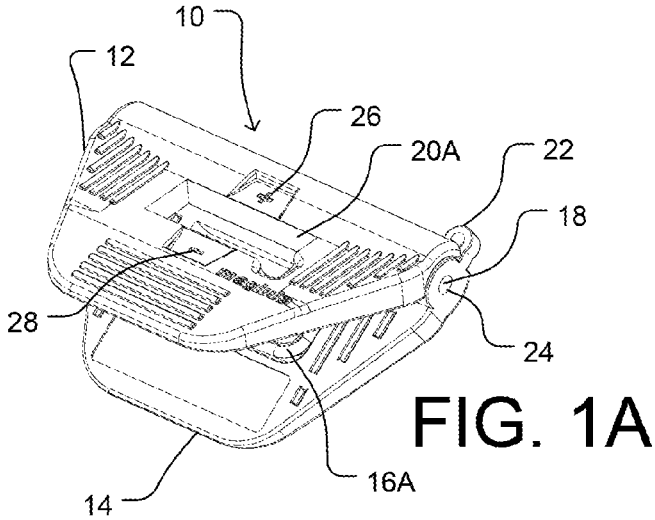
FIG. 1A is a perspective view of our magazine loader in an 'open' position.

| REFERENCE NUMERALS | |
|---|---|
| 10 loader | 12 and 14 flaps |
| 16 torsion spring | 16A and 16B legs of spring 16 |
| 18 hinge pin | 20A and 20B opening in flaps |
| 22 securing ring | 24 through hole |
| 26 "+" mark | 28 "−" mark |
| 30 tube | 40 magazine |
| 42 body of magazine | 44 lips of magazine |
| 46 side slit | 48 spring of magazine |
| 50 side projecting button | 52 follower |
| 60 round(s) of ammunition | 70 alternative loader |
| 72 and 74 alternative flaps | 76 compression spring(s) |

DETAILED DESCRIPTION

First Embodiment

Figure 1B:
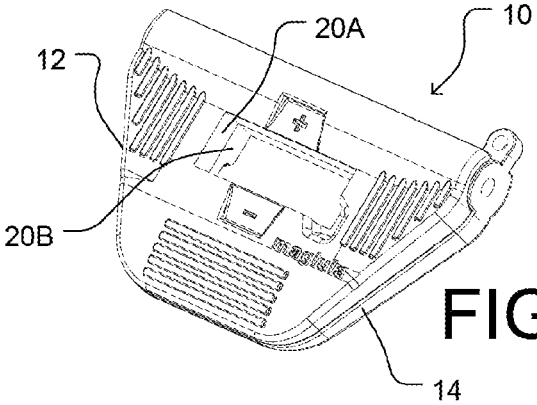
FIG. 1B is a perspective view of the loader in a 'closed' position.
Figure 1C:
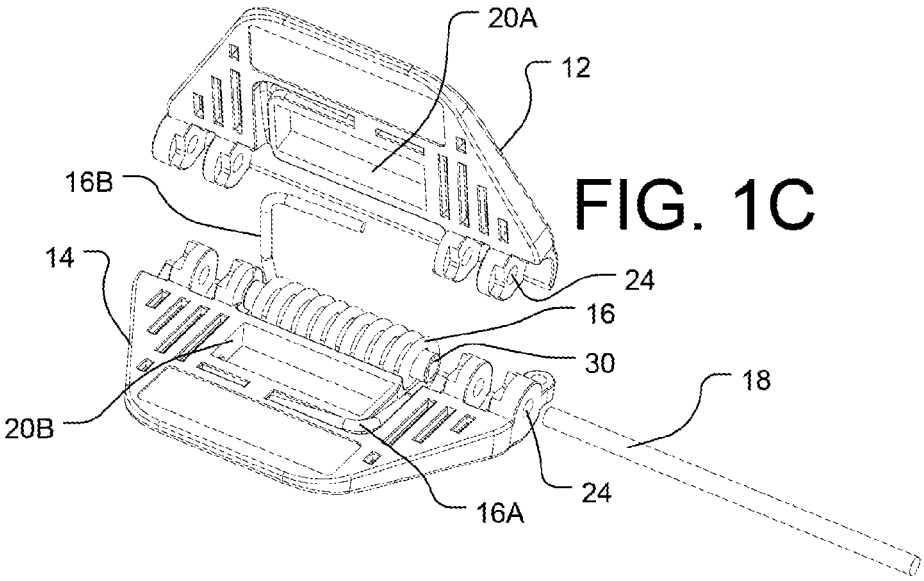
FIG. 1C is an exploded view of the loader.

FIGS. 1A-1C—Perspective Views

FIG. 1A is a perspective view of a first embodiment of our magazine loader 10 shown 'open' in its natural state. Loader 10 preferably comprises four main parts: two substantially flat and similar flaps or wings 12 and 14, a round hinge pin 18 hinging the two flaps together along each longer (rear) side, and a torsion spring 16 (FIG. 1C) positioned between the two flaps with its windings encircling hinge pin 18. Each flap has a generally trapezoidal shape where the two parallel sides are the inner and longer, hinged side and the opposite shorter side and where the two non-parallel sides are inclined toward each other. Spring 16 has two substantially similar L-shaped legs 16A and 16B, each positioned in a deep groove (best shown in FIG. 1C) in the inner side of each flap. Flaps 12 and 14 also have respective substantially rectangular and longitudinally centered holes or openings 20A and 20B (FIGS. 1B and 1C); the two openings are of equal dimensions and are positioned as close to the hinge side as mechanically possible. The openings are sized to accept a magazine.

Each flap also has four hinge knuckles with through holes 24 (FIG. 1C); hinge pin 18 passes through these holes and hinges the two flaps together. The hinge knuckles also have limiters (not numbered) designed to limit the 'open' angle between the flaps to 35°. Further, a securing ring 22 (FIG. 1A) extends from flap 14 so that the loader can be attached by wire or cord (not shown) against loss.

The top flap has a pair of indicia, "+" and "−" marks 26 and 28, on its external face on respective sides of hole 20A. The "+" mark, on the inner or hinge side of the hole, signifies that the loader will have a stronger resisting force or grip on the magazine if the magazine is inserted into the holder with its button on the "+" or hinge side. Conversely, if the magazine is inserted into the holder with its button on the "−" or open side of the hole, the loader with provide a lesser holding force or grip on the magazine.

The flaps of the loader are preferably made of a durable polymer material, such as nylon 6, produced by injection molding process. The torsion spring is preferably made of spring wire material, and hinge pin 18 is preferably made of metal.

FIG. 1B is a perspective view of the loader shown in a 'closed' position where the two flaps substantially touch and parallel each other on their inner flat side. Openings 20A and 20B are aligned.

FIG. 1C is an exploded view of the loader showing its components. Pin 18 couples the flaps through their interleaved knuckles and through holes 24; pin 18 also passes through an aligner tube 30 designed to keep the coils of spring 16 aligned.

Figure 2A:
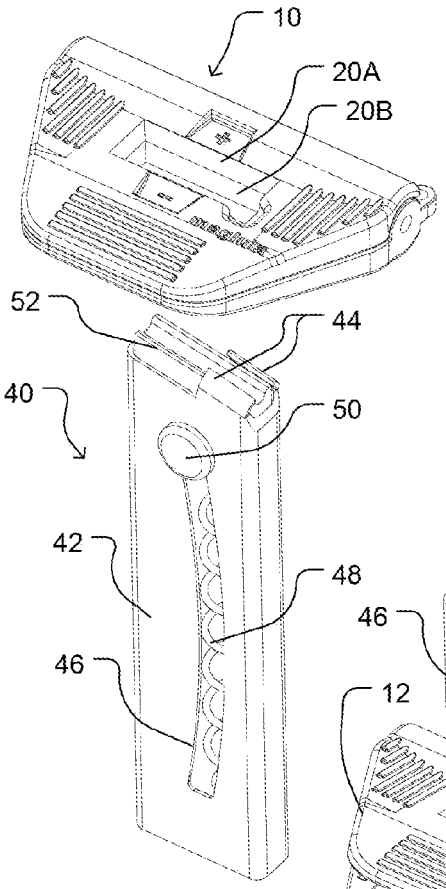
FIG. 2A is a perspective view of the loader shown in a 'closed' position above a magazine.
Figure 2B:
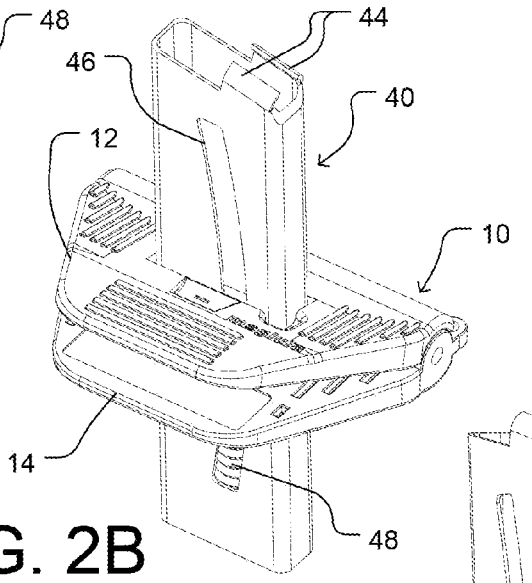
FIG. 2B is a perspective view of the loader in an 'open' and locked position on the magazine.
Figure 2C:
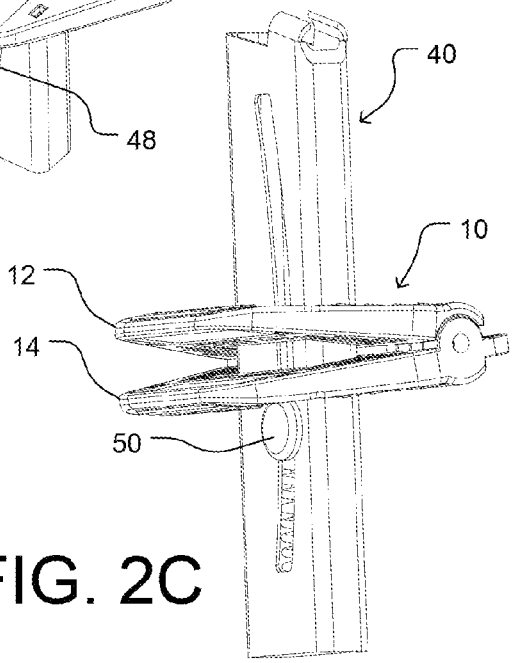
FIG. 2C is another perspective view of the loader of FIG. 2B.

FIGS. 2A-2C—Perspective Views

FIG. 2A is a perspective view of the loader shown with the flaps in a 'closed' or parallel position above a magazine 40. The magazine is aligned with openings 20A and 20B so that the magazine may be inserted through the openings. The magazine type for which the loader is designed has a substantially rectangular and elongated body 42 with at least one longitudinal side slot or slit opening 46. A slider button or nubbin 50 protrudes out from the slot and is coupled to a follower 52, shown protruding from the top of the magazine, under lips 44. The magazine includes a compression spring 48 that urges follower 52 and hence button 50 up towards lips 44 of the magazine.

The loader's openings 20A and 20B are sized slightly larger than the cross-sectional size of the magazine. When the flaps are held in the parallel position shown in FIG. 2A, openings 20A and 20B will be aligned so that the magazine can be easily inserted through the openings. The exact dimensions of the openings are made slightly larger than the width and depth measurements of various magazine bodies having a side projecting button of similar dimensions. In two current versions the loader has openings with two dimensions or sizes, one for the Ruger MK and similarly sized magazines, and a larger opening for Walther P22 and similarly sized magazines; these two loaders will accommodate most such magazines on the market but other sizes may be provided if necessary to accommodate magazines of other sizes.

FIG. 2B is a perspective view of the loader where the flaps are allowed to be rotated partly open by spring 16 to an angled orientation where openings 20A and 20B are not aligned so that they lock and hold the loader on the magazine. In this position lower flap 14 engages slider button 50 (not shown in this figure) down near the bottom of the magazine. The follower in the magazine (not shown in this figure) connected to the button is also held down in the magazine, thus forming a vacant space above the follower in the magazine below lips 44. Spring 48 of the magazine is shown compressed. The angle between the two flaps is now smaller compared with the angle between the flaps in a natural 'open' state (FIG. 1A).

FIG. 2C is a lower view of the loader and magazine of FIG. 2B where flap 14 is shown holding button 50 and hence the follower (not shown in this figure) down. The loader can hold the projecting button anywhere along side slit 46.

Figure 3A:
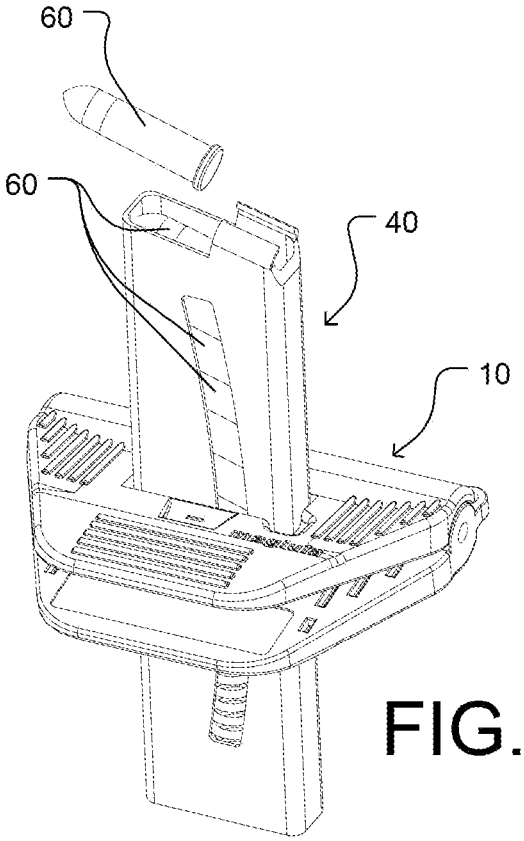
FIG. 3A is a perspective view of the loader on the magazine during loading.
Figure 3B:
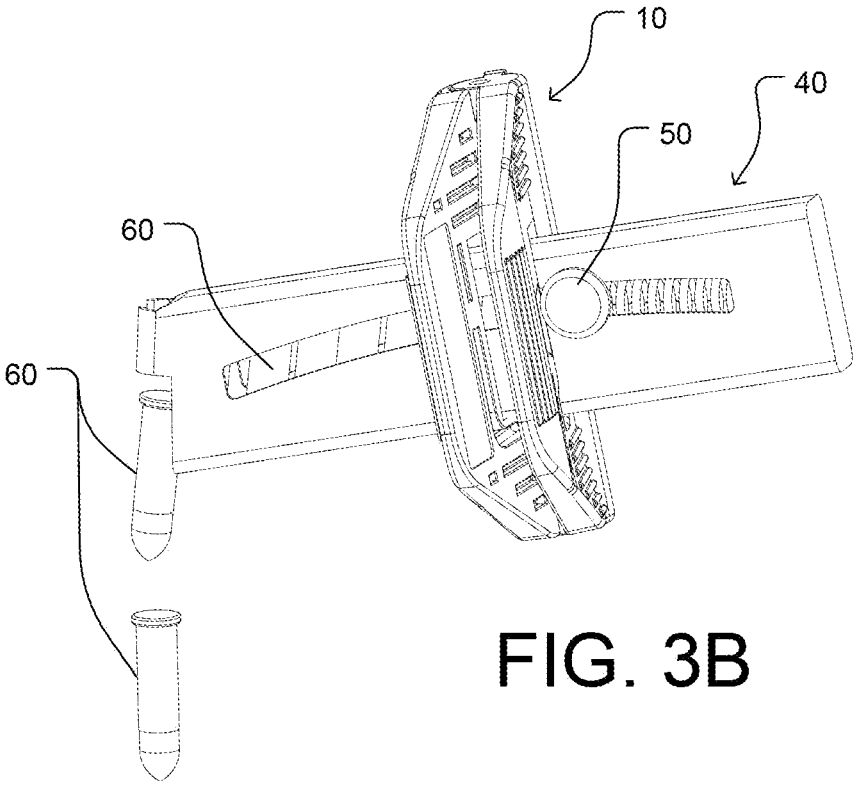
FIG. 3B is a perspective view of the loader on the magazine during unloading.

FIGS. 3A-3B—Perspective Views

FIG. 3A is a perspective view of the loader and magazine as shown and described in connection with FIGS. 2B and 2C but where ammunition rounds 60 are shown loaded in the vacant space in the magazine formed by the loader holding button 50 and follower 52 (not shown in this figure) down. A topmost round is shown prior to being loaded in a left-over vacant space below lips 44.

FIG. 3B is a perspective view of the loader and magazine as shown and described for FIG. 3A. The loader is now in an unloading position and is tilted approximately horizontal to allow the rounds to sequentially slide and fall out from the magazine.

Operation—FIGS. 2A-3B

The loader provides substantial assistance to a firearm user by safely, comfortably, and rapidly loading a magazine without finger pain or injury. The magazines for which the loader is designed for all have a side projecting button, and are usually of the single-stacked type and hold .22LR rounds. As stated, the range of magazines and round calibers may be extended or altered by changing the dimensions of the loader's parts.

Principally, loading rounds into the magazine is accomplished by operating the loader to provide sufficient vacant space below the magazine's lips for rearwardly inserting (case first) a new round into the vacant space. This is accomplished by forcing down the side projecting button with the loader to compress the spring of the magazine sufficiently into the magazine to form the vacant space below the lips and above the follower. The loader then holds the button down. The user then sequentially and effortlessly drops new rounds below the lips into the vacant space filling the magazine. Once the magazine is full, the loader is removed, allowing the magazine's spring and follower to push up all the rounds in the magazine until the topmost round engages the lips.

In detail, to load rounds into the magazine, loader 10 is first closed by the user's fingers (not shown) by pressing the smaller, free ends of the flaps (distant from their hinge sides) together to a parallel orientation, as illustrated in FIG. 2A.

Once closed, openings 20A and 20B of the loader become aligned so that, as shown in FIG. 2B, the aligned openings and the loader can be slid down onto magazine 40. Stated conversely, the magazine can be inserted upwardly through aligned openings 20A and 20B of the loader as shown. When the loader is slid downward over the magazine it will engage or contact button 50, forcing it and the internal follower (not shown) down. The user keeps the loader closed while sliding it downward so that openings 20A and 20B will remain aligned.

Once the button is sufficiently down, the user releases the loader, allowing flaps 12 and 14 to spread and angle apart by outward force from spring 16. This will cause openings 20A and 20B to move out of alignment and thereby forcefully grasp or engage the body of magazine 40. The torque or force exerted by the openings of the two inclined flaps on the magazine's body creates sufficiently high friction between the flaps and the magazine to keep the loader and button down in place against the force from the magazine's spring 48, which urges follower 52 and side button 50 upward. The torque of spring 16 of the loader is designed to be at least 50 kg/mm, which is sufficient to hold down the buttons of all tested magazines. The width of openings 20A and 20B is preferably in the range of 0.1 mm to 0.3 mm larger than the width of the widest magazine in a selected range of magazines so to provide a tight angle of the flaps on the magazine and thus create higher holding force.

The magazine can be inserted into the loader in either of two ways: With button 50 on the "–" or outer side of openings 20A and 20B as shown in FIG. 2A, or with button 50 on the "+" or inner (hinge) side of the openings (not shown). When the loader is installed on the magazine, button 50 pushes the lower flap up in response to force from the magazine's spring and hence follower 52. If the magazine is inserted so that button 50 is on the outer side of the openings as shown in FIG. 2A, the button will have less leverage against the force of loader spring 16 than if the magazine were inserted so that the button were on the inner or hinge side of the openings. Thus when the button is on the outer side of the openings it will not be able to close the flaps of the loader as much as it would be able to do when it is on the inner or hinge side of the openings. When the flaps are not closed as much (button on inner side) the openings will be less aligned and hence will grip the magazine more tightly than when the flaps are closed more (button on outer side), where the loader will grip the magazine less tightly. Thus, marks 26 and 28 ("+" and "–") on the loader signify that for a stronger locking force or grip on the magazine, the magazine should be inserted so that its button is on the side of the "+" mark (closer to the loader's hinge). Conversely for a weaker locking or gripping force the magazine should be inserted so that the button is on the side of the "–" mark (farther from the hinge).

Once the loader is locked on the magazine as illustrated in FIG. 3A, the user can easily and comfortably slide rounds 60 in the vacant space below lips 44 of the magazine until the magazine is full. The user can then squeeze-close the two flaps to bring the holes on the loader into greater alignment to remove their grip on the magazine and thereby enable a user to slide the loader up and off from the magazine, or conversely, the magazine can be pulled down out of the loader. The flaps thus enable the loader to grasp or release the magazine. Thus when the flaps are pressed or folded together (FIG. 2A) the opening is relatively large so that it will fit or slide over magazine 40 but not its button 50. The opening is manually changeable in size so that when the flaps are allowed to spread apart, open, or unfold to an angular orientation (FIG. 2B), the opening becomes effectively smaller so that the loader can grasp magazine 40 over a range of positions along the magazine and thereby hold button 50 (and hence follower 52) at any of a range of positions in slot 46.

To unload rounds from the magazine, the user can lock the loader down on a loaded magazine as follows: (a) fold the loader's wings together to align the holes in the flaps, (b) slide the loader onto the top of the magazine, (c) slide or move the loader down to force button 50 down against the magazine' spring force, and (d) release the flaps so that the loader will grasp the magazine tightly enough to hold the button down. Then, the magazine and loader are tilted as shown in FIG. 3B and shaken slightly to allow the rounds to sequentially drop out of the magazine.

Figure 4A:
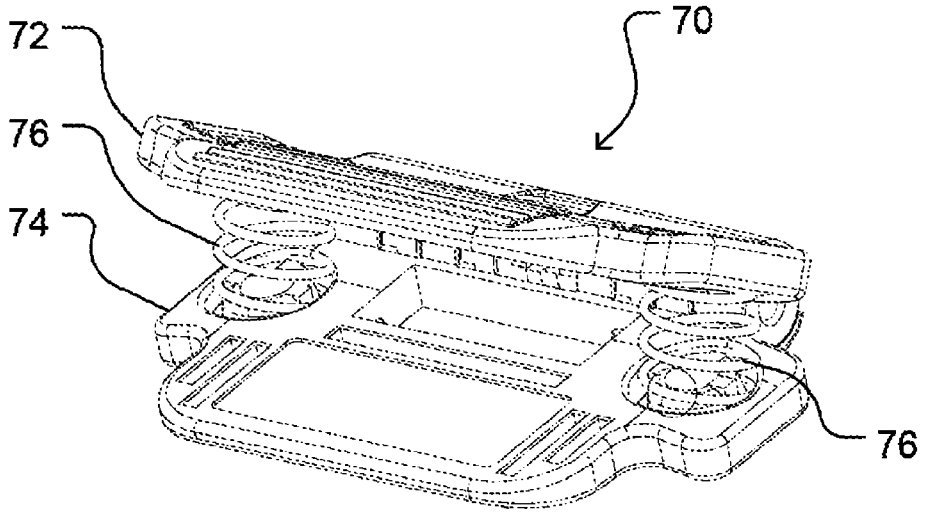
FIG. 4A is a perspective view of an alternative loader.

FIG. 4A—Alternative Loader

FIG. 4A is a perspective view of an alternative loader 70 with flaps 72 and 74, which have a similar construction to the embodiment of FIG. 1A. Here two helical compression springs 76 replace the torsion spring of the first embodiment described previously. The springs are positioned in substantially deep depressions (not numbered) in the inner sides of flaps 72 and 74 and are designed as such that the flaps can be closed together. Loader 70 operates similarly to loader 10 described above.

CONCLUSION, RAMIFICATIONS, AND SCOPE

The reader will see that we have provided an efficient, palm-size, comfortable, and safe magazine loader comprising few parts that can load magazines having a projecting side button. The loader shown can load a wide range of magazines by locking and holding the slider button and follower in position anywhere along the magazine for allowing painless, comfortable, and also non-continuous loading.

While the above description contains many specificities, these should not be construed as limitation on the scope but rather as an exemplification of several embodiments thereof.

All numerical values provided are approximate; they are variable to adapt to other magazines or round types and or sizes. The following are further examples of some but not all variations and ramifications:

The loader is constructed to fit and operate with most substantially pistol magazines available in the market having a projecting side button. It can be altered to fit other magazines and calibers provided a suitable change in dimensions is made in the loader.

The loader, as well as its components, may be made of separate or different plastic materials, or, alternatively, of other materials, such as aluminum or steel, or any combination thereof.

Various other spring types or other mechanical means or methods may replace the torsion spring mentioned. Such can be a double torsion-spring, a flat steel spring, flexible rubber, or a flexible polymer spring member.

The open-angle limit mechanism of the hinge may be designed differently.

The loader may also be constructed to include insertable spacer(s) in the openings to accommodate magazines of different dimensions.

Many types of flaps can be designed for the loader, either to adapt to specific magazines, to allow for larger finger rest, or to include other features. Only two types were described above. They all share the basic method of loading.

The hinging of the two flaps may be different to that shown and may be positioned elsewhere in the flaps or loader. The shapes of the flaps can be varied so that they have a rectangular configuration, a rounded, semi-circular configuration with flat inner sides, inner sides that are shorter than the outer sides, etc.

A lock mechanism may be included in the loader to lock and keep the flaps closed so to reduce the size of the loader for transport and storage.

The described loader can be amended to lock on rifle and submachine gun magazines having a side projecting button.

The loader can be amended to lock on magazines with a non-projecting side button. The loader would then have to include a mechanism, as a protrusion, to engage with the non-projecting side button.

In addition to the use of "+" and "−" signs, other indicia may be used, such as the words "more [force]" and "less [force]", the letters "T" [Tighter] and "L" [Looser], etc.

In lieu of a loader with two flaps, an alternative loader can be a member having a hole or opening large enough to slide over the magazine but not its projecting button. The loader has a spring-loaded lever or actuating button (actuator) connected to a grasping member that normally extends into the loader's opening. When the actuator is pressed, this withdraws the grasping member from extending into the opening so that the loader can be inserted over the magazine and moved or slid downward to force the magazine's button and rounds follower down, as before. When the actuator is released, this allows the grasping member to extend into the opening and grasp or press against the magazine so as to hold the loader in place and keep the magazine's button and follower down. In this way the loader can provide the same function as the loader previously shows without the use of flaps.

The alternative loader can be arranged so that the grasping member normally is withdrawn from extending into the opening so that the loader can be inserted over the magazine, whereupon the actuator is operated to cause the grasping member to grasp the magazine and lock the actuator in place, either while the actuator is held or semi-permanently until the actuator is operated again.

An industrial machine using the methods and lock mechanism described here may be designed for mass loading rounds into magazines. This machine may be used in military armories, shooting ranges, and in production plants.

Accordingly, the scope of our loader should be determined not by the embodiments illustrated, but by the appended claims and their legal equivalents.

The invention claimed is:

1. A loader for a firearm magazines of the type comprising an elongated housing with two opposite ends, one of which is a rounds-feeding end and the other of which is a bottom opposite end and a predetermined cross-sectional shape when viewed from one of said ends, where said magazine has a plurality of oppositely facing sides connecting said ends, a slot on one of said sides, a moveable button projecting from said slot, a rounds follower or pusher inside said magazine coupled to said button, and a rounds-follower spring inside said magazine for urging said follower or pusher toward said rounds-feeding end of said magazine, said loader comprising:

a pair of connected flaps, each flap having a hinge inner side and an opposite outer side, said flaps being hinged together at said hinge sides so that they can be folded together to a substantially parallel condition or unfolded to an angular or inclined state with an apex at said hinge sides, each of said flaps having a opening therethrough, a loader spring for urging said flaps apart from said folded-together state to form said angular state, said openings being positioned so that (a) when said flaps are folded together said openings are substantially aligned so as to accommodate said predetermined cross-sectional shape of said magazine so that said magazine can be inserted, rounds-feeding end first, through said substantially aligned openings, but said projecting button will not pass through said substantially aligned openings, and (b) when said flaps are unfolded said openings are substantially out of alignment so they will grip said cross-sectional shape of said magazine so as to hold said projecting button and said rounds follower in a position where said rounds follower compresses said rounds-follower spring inside said magazine whereby when said flaps of said loader are folded and held together, said loader can be inserted over said magazine to force said button away from said rounds-feeding end and when said flaps are not held together said spring will urge said flaps apart to an unfolded to an angular or inclined state, so that said flaps will grip said sides of said magazine and hold said button away from said rounds-feeding end of said magazine so that rounds can easily be loaded into said magazine.

2. The loader of claim 1, further including a hinge pin for hinging said flaps together at said hinge end and wherein said loader spring is a torsion spring that is coiled around said hinge pin.

3. The loader of claim 1 wherein said loader spring is a compression spring positioned between said flaps of said loader.

4. The loader of claim 1, further including said firearm magazine, said magazine having a predetermined cross-sectional shape similar to that of said openings in said loader, said magazine being sized so that when said flaps of said loader are folded and its openings are aligned, said magazine can be slid through said aligned openings and said loader can push said moveable button along said slot, and when said flaps of said loader are unfolded to an angular or inclined state, said flaps will grip said sides of said magazine and hold said button from sliding.

5. The loader of claim 1, further including a pair of indicia on at least one of said flaps on respective sides of said opening in said flap to indicate directions in which said magazine may be inserted and said button may be positioned for a tighter or looser grip of said loader on said magazine.

6. The loader of claim 1 wherein each of said flaps has a trapezoidal shape with parallel inner hinge and outer sides and two non-parallel sides which connect said inner and outer sides and which are inclined towards each other.

7. A method for retracting a rounds follower or pusher of a firearm magazine of the type comprising an elongated housing with two opposite ends, one of which is a rounds-feeding end and the other of which is a bottom opposite end and a predetermined cross-sectional shape when viewed from one of said ends, where said magazine has a plurality of oppositely facing sides connecting said ends, a slot on one of said sides, a moveable button projecting from said slot, a rounds follower or pusher inside said magazine coupled to said button, and a rounds-follower spring inside said magazine for urging said follower or pusher toward said rounds-feeding end of said magazine, comprising:

providing a loader having an opening that can fit or slide over said magazine but not said projecting button, said opening being manually adjustable in size so that said loader can grasp said magazine over a range of positions along said magazine and hold said projecting button at any of a range of positions in said slot, adjusting said loader so that said opening is large enough to fit or slide over said magazine and then sliding said opening of said loader over said magazine and pushing said projecting button of said magazine away from said rounds-feeding end of said magazine, adjusting said loader so that said loader grasps said magazine and holds said projecting button of said magazine away from said rounds-feeding end of said magazine, whereby when said loader is adjusted so that said loader does not grasp said magazine, said loader can be inserted over said magazine to force said button away from said rounds-feeding end and when said loader is adjusted so that said loader grasps said magazine, said loader will hold said button away from said rounds-feeding end of said magazine so that rounds can easily be loaded into said magazine.

8. The method of claim 7 wherein said loader includes a pair of connected flaps, each flap having a hinge inner side and an opposite outer side, said flaps being hinged together at said hinge sides so that they can be folded together to a substantially parallel condition or unfolded to an angular or inclined state with an apex at said hinge sides, each of said flaps having a hole therethrough, a loader spring for urging said flaps apart from said folded-together state to form said angular state, said holes being positioned so that (a) when said flaps are folded together said holes are substantially aligned so as to provide said opening to accommodate said predetermined cross-sectional shape of said magazine so that said magazine can be inserted, rounds-feeding end first, through said substantially aligned holes, but said projecting button will not pass through said substantially aligned holes, and (b) when said flaps are unfolded said holes are substantially out of alignment so they will grasp said cross-sectional shape of said magazine so as to hold said projecting button and said rounds follower in a position where said rounds follower compresses said rounds-follower spring inside said magazine.

9. The method of claim 8 wherein said loader includes a hinge pin for hinging said flaps together at said hinge end and wherein said loader spring is a torsion spring that is coiled around said hinge pin.

10. The method of claim 9 wherein said loader spring is a compression spring positioned between said flaps of said loader.

11. The method of claim 8, further including providing said firearm magazine, said magazine having a predetermined cross-sectional shape similar to that of said holes in said loader, said magazine being sized so that when said flaps of said loader are folded and its holes are aligned, said magazine can be slid through said aligned holes and said loader can push said moveable button along said slot, and when said flaps of said loader are unfolded to an angular or inclined state, said flaps will grip said sides of said magazine and hold said button from sliding.

12. The method of claim 8 wherein said loader further includes a pair of indicia on at least one of said flaps on respective sides of said hole in said flap to indicate directions in which said magazine may be inserted into said loader for a tighter or looser grip of said loader on said magazine.

13. The method of claim 8 wherein each of said flaps has a trapezoidal shape with parallel inner hinge and outer sides and two non-parallel sides which connect said inner and outer sides and which are inclined towards each other.

14. A loader for retracting a rounds follower or pusher of a firearm magazine of the type comprising an elongated housing with two opposite ends, one of which is a rounds-feeding end and the other of which is a bottom opposite end and a predetermined cross-sectional shape when viewed from one of said ends, where said magazine has a plurality of oppositely facing sides connecting said ends, a slot on one of said sides, a moveable button projecting from said slot, a rounds follower or pusher inside said magazine coupled to said button, and a rounds-follower spring inside said magazine for urging said follower or pusher toward said rounds-feeding end of said magazine, comprising:

a member having an opening that can fit or slide over said magazine but not said projecting button, said opening of said member being manually changeable in size so that said member can grasp said magazine over a range of positions along said magazine and thereby hold said projecting button at any of a range of positions in said slot, whereby when said loader is operated so that said member does not grasp said magazine, said loader can be inserted over said magazine to force said button away from said rounds-feeding end and when said loader is operated so that said member grasps said magazine, said loader will grasp said magazine and hold said button away from said rounds-feeding end of said magazine so that rounds can easily be loaded into said magazine.

15. The loader of claim 14 wherein said member comprises a pair of connected flaps, each flap having a hinge inner side and an opposite outer side, said flaps being hinged together at said hinge sides so that they can be folded together to a substantially parallel condition or unfolded to an angular or inclined state with an apex at said hinge sides, each of said flaps having a hole therethrough, a loader spring for urging said flaps apart from said folded-together state to form said angular state, said holes being positioned so that (a) when said flaps are folded together said holes are substantially aligned so as to provide said opening to accommodate said predetermined cross-sectional shape of said magazine so that said magazine can be inserted, rounds-feeding end first, through said substantially aligned holes, but said projecting button will not pass through said substantially aligned holes, and (b) when said flaps are unfolded said holes are substantially out of alignment so said flaps will grip said cross-sectional shape of said magazine so as to hold said projecting button and said rounds follower in a position where said rounds follower compresses said rounds-follower spring inside said magazine.

16. The loader of claim 15, further including a hinge pin for hinging said flaps together at said hinge end and wherein said loader spring is a torsion spring that is coiled around said hinge pin.

17. The loader of claim 15 wherein said loader spring is a compression spring positioned between said flaps of said loader.

18. The loader of claim 15, further including said firearm magazine, said magazine having a predetermined cross-sectional shape similar to that of said holes in said loader, said magazine being sized so that when said flaps of said loader are folded and its holes are aligned, said magazine can be slid through said aligned holes and said loader can push said moveable button along said slot, and when said flaps of said loader are unfolded to an angular or inclined state, said flaps will grip said sides of said magazine and hold said button from sliding.

19. The loader of claim 15, further including a pair of indicia on at least one of said flaps on respective sides of said hole in said flap to indicate how said magazine and its button may be inserted into said loader for a tighter or looser grip of said loader on said magazine.

20. The loader of claim 15 wherein each of said flaps has a trapezoidal shape with parallel inner hinge and outer sides and two non-parallel sides which connect said inner and outer sides and which are inclined towards each other.

21. A spring loaded magazine loader, comprising:

two substantially flat flaps, each of which has a hinge end, said flaps being hinged together at their hinge ends so as to allow said flaps to be rotated to either a substantially parallel orientation or to an angled orientation where said flaps define an angle therebetween with an apex at said hinged end, each flap having a substantially rectangular opening which is aligned with the opening of said other flap when said flaps are in said parallel orientation and which is not aligned with the opening of said other flap when said flaps are in said angled orientation, a spring positioned in said loader for urging said flaps apart about said hinged ends to said angled orientation, whereby when said flaps are in said parallel orientation and a firearm magazine of the type having a side-projecting follower button is inserted through said aligned openings of said flaps, said loader will for engage and retract said follower button down along said magazine, and when said flaps are angled apart by said spring, said follower button will be held in position by said flaps in said angular orientation, allowing firearm rounds to be loaded in said magazine; and when said flaps are rotated to said parallel orientation again, said loader may be retracted from said magazine.

* * * * *